United States Patent [19]

Nakazato

[11] Patent Number: 4,476,834

[45] Date of Patent: Oct. 16, 1984

[54] AIR-FUEL RATIO CONTROL SYSTEM

[75] Inventor: Kazuo Nakazato, Fuchu, Japan

[73] Assignees: Fuji Jukogyo Kabushiki Kaisha, Tokyo; Nissan Motor Company, Limited, Yokohama, both of Japan

[21] Appl. No.: 382,457

[22] Filed: May 26, 1982

[30] Foreign Application Priority Data

May 29, 1981 [JP] Japan ..... 56/82874

[51] Int. Cl.[3] ..... F02B 3/00

[52] U.S. Cl. ..... 123/440; 123/478; 123/492

[58] Field of Search ..... 123/440, 478, 480, 489, 123/490, 492, 493

[56] References Cited

U.S. PATENT DOCUMENTS

| | | | |
|---|---|---|---|
| 4,202,295 | 5/1980 | Kondo et al. | 123/478 |
| 4,240,389 | 12/1980 | Shimazuki | 123/492 |
| 4,348,996 | 9/1982 | Morozumi | 123/440 |
| 4,364,358 | 12/1982 | Shikada et al. | 123/440 |

*Primary Examiner*—Raymond A. Nelli
*Attorney, Agent, or Firm*—Martin A. Farber

[57] ABSTRACT

A system for controlling air-fuel ratio of air-fuel mixture for an internal combustion engine having a two-barrel carburetor. The system is provided with an $O_2$ sensor for detecting the concentration of oxygen in the exhaust gases, an on-off electromagnetic valve for correcting the air-fuel ratio of the air-fuel mixture supplied by the carburetor and an electronic control circuit. The electronic control circuit operates to compare output signal of the detector with a stoichiometric value, and to produce driving pulses for driving the on-off electromagnetic valve and for controlling the air-fuel ratio to a value approximately equal to the stoichiometric air-fuel ratio. A fixed signal generating circuit is selectively connected to the electronic control circuit. The two-barrel carburetor has an actuator actuated by the vacuum at the venturi of the carburetor for opening a throttle valve of the secondary side of the carburetor. A first switch is provided to be operated in response to the actuation of the actuator and connected to a second switch in the control circuit. The second switch connects the fixed signal generating circuit to the electronic control circuit for providing a fixed duty ratio for the valve and renders the electronic control circuit non-responsive to the output of the $O_2$ sensor.

7 Claims, 5 Drawing Figures

AIR-FUEL RATIO CONTROL SYSTEM

BACKGROUND OF THE INVENTION

The present invention relates to an air-fuel ratio control system with an electrically-controlled carburetor in an intake system of an internal combustion engine and with a three-way catalytic converter in an exhaust system for detecting the oxygen concentration of exhaust gases. The air-fuel ratio control system controls the air-fuel ratio of an air-fuel mixture to a stoichiometric air-fuel ratio at which the three-way converter is most effective and controls the air-fuel ratio to a fixed rich air-fuel ratio (a small air-fuel ratio) during middle- or high-speed driving and during heavy load driving, so that the controlled air-fuel ratio range and the fixed air-fuel ratio range are adjusted properly to the vehicle driving conditions.

In Japanese patent application, Nos. 54-98921 and 55-10678, the present applicant has already proposed an air-fuel control system provided with a detecting device for detecting a heavy load operation of the engine and with a control circuit for controlling the air-fuel ratio to a fixed rich ratio in order to produce high power for the heavy load operation.

In such a conventional system, because the intake passage vacuum and the throttle opening degree vary in dependency on the load, a certain value of the intake passage vacuum or throttle opening degree is selected for the detection of the heavy load operation. For instance, in a load characteristic shown in FIG. 1, a curve A is a torque curve of the full throttle open condition and a curve B shows a detecting characteristic of a vacuum detecting device which operates at −80 mmHg. By the intake passage vacuum detecting method, in the range lower than the curve B, the air-fuel ratio is controlled to the stoichiometric air-fuel ratio, but in the range higher than the curve B the ratio is fixed to a rich air-fuel ratio for powerful operation. Also in the throttle opening degree method, ranges are defined by a curve C.

As clearly shown in FIG. 1, the fixed air-fuel ratio range higher than the curve B exists in the low engine speed zone with a considerable width and is narrow in the high speed zone. Such a low speed driving is usual mainly on urban streets. However, the powerful operation by the fixed air-fuel ratio is not necessary on urban streets, but it is important to decrease noxious exhaust gas emission. In addition, it is unfavorable under high speed driving under heavy load conditions, for the fixed air-fuel ratio range to be narrow in a high speed zone.

On the other hand, by the throttle opening degree detecting method the fixed air-fuel ratio range at the low speed zone is narrower than with the vacuum detection method, but the exhaust gas purification effect is still insufficient. Further, the fixed air-fuel ratio range at the middle and high speed zone is broad, resulting in increases of noxious gas emission.

SUMMARY OF THE INVENTION

In order to overcome such defects of conventional systems, it is an object of the present invention to provide an air-fuel ratio control system for an internal combustion engine, which is provided with a sensor responsive to vacuum in a venturi of a carburetor of the engine for detecting conditions of engine operation and for determining the range of the controlled air-fuel ratio range.

According to the present invention, there is provided an air-fuel ratio control system for an internal combustion engine having a two-barrel carburetor with primary and secondary intake passages, primary and secondary venturis in the intake passage, a throttle valve in the intake passage, an exhaust passage, an $O_2$ sensor for detecting the concentration of a constituent of exhaust gases passing through the exhaust passage, an on-off electromagnetic valve for correcting the air-fuel ratio of the air-fuel mixture supplied by said two-barrel carburetor, an electronic control circuit comprising a comparator for comparing an output signal of the $O_2$ sensor with a reference value, a proportional and an integrating circuit and a driving circuit means for producing driving pulses for driving the electromagnetic valve in dependency on an output signal of the proportional and integrating circuit for controlling the air-fuel ratio to a value approximate to the stoichiometric air-fuel ratio, a fixed signal generating circuit means for supplying a rich air-fuel ratio signal to the driving circuit means; detecting means comprising a vacuum operated device having a diaphram responsive to the vacuum at the venturi for detecting a condition of operation of the internal combustion engine and producing a detected signal by a high venturi vacuum, the vacuum operated device operatively is connected with a throttle valve in the secondary intake passage for actuating the throttle valve in dependency on high venturi vacuum, and and switch means provided to be operated by the detected signal of the vacuum operated device for rendering the output signal of the $O_2$ sensor ineffective and for feeding the fixed signal to the driving circuit means.

BRIEF DESCRIPTION OF DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 2:
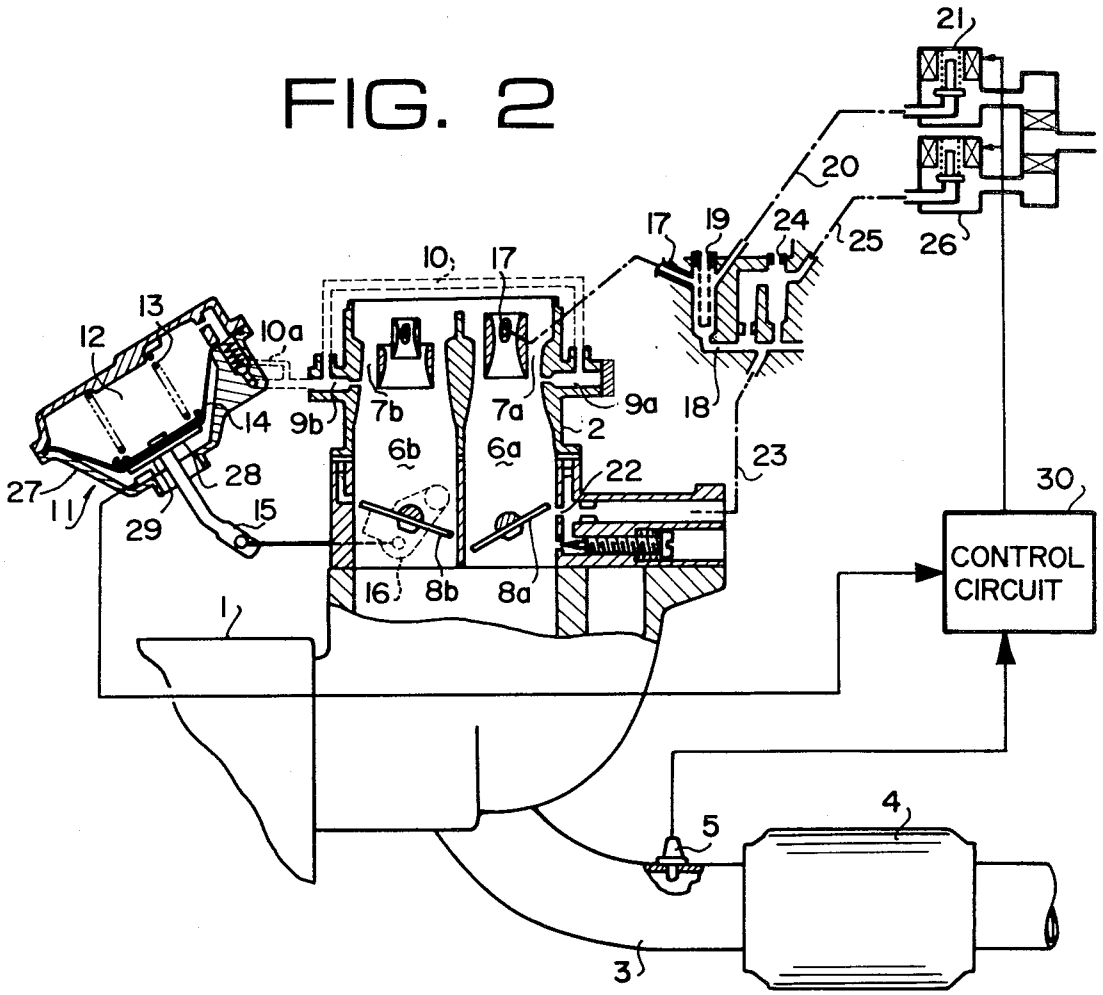
FIG. 2 shows a construction of an air-fuel control system in accordance with the present invention.

An embodiment of the present invention will be explained with reference to drawings. In FIG. 2, an internal combustion engine 1 is provided with a two-barrel carburetor 2 comprising a primary side and a secondary side, and an exhaust pipe 3. A catalytic converter 4 with a three-way catalyst is disposed in the exhaust pipe 3 and an $O_2$ sensor 5 is also disposed in the exhaust pipe 3 at an upstream side of the catalytic converter 4 for detecting the oxygen concentration of the exhaust gases.

The carburetor 2 is provided with a primary and secondary intake passages *6a* and *6b*, primary venturis *7a*, *7b* and throttle valves *8a*, *8b*. The narrow portions of the primary and secondary passages are formed as venturis, where vacuum ports 9a and 9b are disposed. Both ports communicate with a vacuum chamber 12 of an actuator 11 of the diaphragm type through a vacuum passage 10. The actuator comprises a diaphragm spring 13, a diaphragm 14, the vacuum chamber 12, and a link mechanism 15 connected to a lever 16 of the throttle valve 8b in the secondary side. A main nozzle 17 opening into the primary venturi 7a of the primary side communicates with a main fuel passage 18 which is provided with an air bleed 19. The main fuel passage communicates with a float chamber (not shown) of the carburetor. The air bleed 19 communicates with an on-off type electromagnetic valve 21 through an air correcting passage 20 for supplying air to the air bleed 19. A slow fuel passage 23 branches off from the passage 18 and communicates with a slow port 22 opening in vicinity of the closed position of the throttle valve 8a. A slow air bleed 24 communicates with an on-off type electromagnetic valve 26 through an air correcting passage 25. On the contrary, although the primary venturi 7b of the secondary side is provided with a main fuel system, an air correcting system such as that of the primary side is not provided because it is not necessary to control the air-fuel ratio during powerful driving by the operation of the secondary side of the carburetor. If the air fuel ratio control is necessary also with such powerful driving, the electromagnetic valve 26 can be used for the control, since the electromagnetic valve 26 for light load operation is not used for a such a powerful driving condition.

Figure 1:
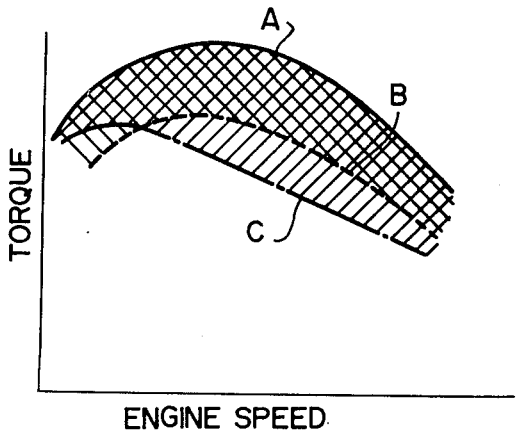
FIG. 1 (PRIOR ART)
FIG. 1 is a graph showing ranges of a fixed air-fuel ratio by conventional control systems.
Figure 3:
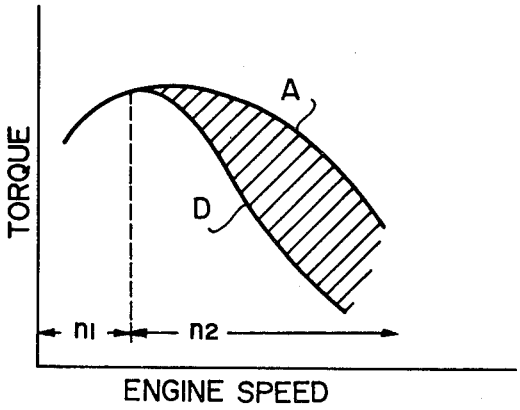
FIG. 3 is a graph showing a range of a fixed air-fuel ratio by the system in accordance with the present invention.

In accordance with the present invention, a switch 29 is provided in the actuator 11. The switch 29 is secured to a casing 27 of the actuator 11 and adapted to be operated by a plate 28 secured to the diaphragm 14. The switch 29 is arranged so as to close a circuit when the diaphragm 14 is deflected by a high vacuum generated in the venturi at heavy load, which causes the secondary throttle valve 8b to be actuated. Thus the fixed air-fuel ratio range is determined by the vacuum in the vacuum chamber 12 of the actuator 11. As shown in FIG. 3, when the actuator operates the torque curve is shown by "D". In a low speed zone $n_1$, the fixed air-fuel ratio range hardly exists because the diaphragm 14 is not deflected in such a low speed zone. In the middle or high speed zone $n_2$, the venturi vacuum increases rapidly so as to close the switch 29 and a wide range of the fixed air-fuel ratio can be obtained.

Figure 4:
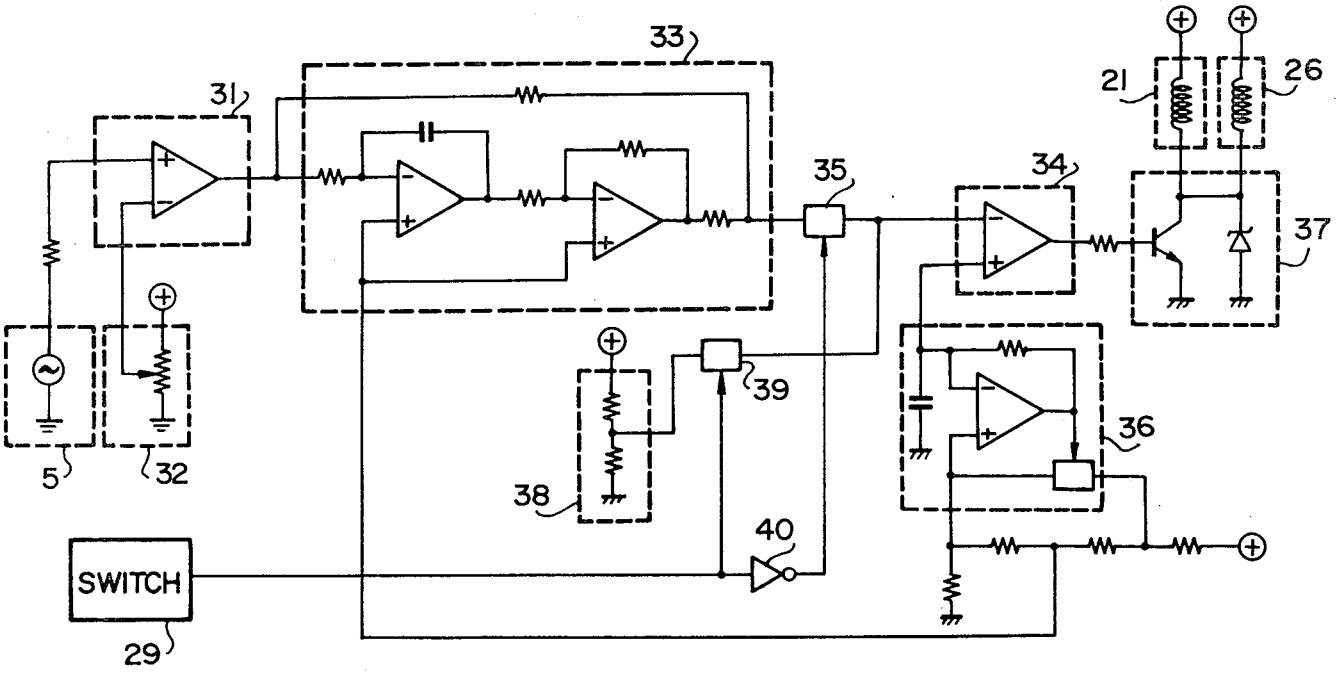
FIG. 4 is a control circuit employed in the system of FIG. 2.

The outputs of the $O_2$ sensor 5 and the switch 29 are connected electrically to the electromagnetic valves 21 and 26 through a control circuit 30. Referring to FIG. 4 showing a control circuit employed in the system, the output signal of the $O_2$ sensor 5 is fed to a comparator 31. The comparator 31 operates to compare the input signal with a reference value applied from a reference value circuit 32 to produce a deviation signal. The deviation signal is fed to a proportional and integrating circuit 33, so that the deviation signal is converted into a proportional and integrating signal. The proportional and integrating signal is fed to a comparator 34 through a semiconductor switch 35 and is compared with triangular pulses fed from a triangular wave pulse generator 36, so that square wave pulses are produced. The square wave pulses are fed to a driver 37 and further to both of the on-off type electromagnetic valves 21 and 26.

In accordance with the present invention, a fixed duty ratio signal generating circuit 38 is connected to the comparator 34 through a semiconductor switch 39. The control gate of the switch 35 is connected to the switch 29 through an inverter 40 and the control gate of the switch 39 is connected to the switch 29.

At a light load operation lower than the curve D (FIG. 3), the output of the switch 29 is low. Therefore, the output of the inverter 40 is high, so that the switch 35 is closed and the switch 39 is opened. Thus, the proportional and integrating circuit 33 is connected to the comparator 34. In such a condition, when exhaust gases having a small oxygen concentration (namely, a rich air fuel ratio) are detected by the $O_2$ sensor 5, the proportional and integrating circuit 33 produces an output signal for correcting the deviation of the air-fuel ratio. According to the output signal, the driver 37 produces output pulses having a greater pulse duty ratio, whereby the opening times of the on-off type electromagnetic valves 21 and 26 increase and as a result, the amount of air passing through the passages 20 and 25 increases. Thus, the air-fuel ratio of the mixture fed from the carburetor 2 is increased. When a lean air-fuel ratio is detected, the driving pulses having a small pulse duty ratio are produced, where air-fuel ratio is decreased to enrich the mixture fed from the carburetor.

When the engine speed increases and the venturi vacuum increases, the diaphragm 14 is deflected, and the secondary throttle valve 8b is opened for heavy load operation at the middle and high speed zone. At that time, the switch 29 is closed, so that the switch 35 is opened and the switch 39 is closed. Therefore, a fixed duty ratio signal for a rich air-fuel mixture is fed from the circuit 38 to the comparator 34 through the switch 39. Thus, the valves 21 and 26 are driven at the fixed duty ratio to provide a rich air-fuel ratio for powerful operation.

Explaining in detail, the low speed zone or middle or high speed zones at light load, venturi vacuum obtained at the vacuum port 9a is small and cancelled by the atmospheric pressure at the port 9b. Therefore, the vacuum in the vacuum chamber 12 of the actuator 11 is almost zero, so that the diaphragm 14 and the link mechanism 15 are pressed by the spring 13 to close the secondary throttle valve 8b. At that time the vacuum switch 29 is turned off, and hence the control circuit 30 operates as a feedback control system as described above.

Under middle or high speed conditions at heavy load, and when the opening degree of the primary throttle valve 8a is increased to a heavy load degree, the venturi vacuum at the vacuum port 9a is rapidly increased, and accordingly, the vacuum in the vacuum chamber 12 is intensified because of the vacuum introduced therein through the passage 10a, whereby the diaphragm 14 is deflected to open the secondary throttle valve 8b. Accordingly, the venturi vacuum is obtained also at the vacuum port 9b and combined with the vacuum at the vacuum port 9a, resulting in a rapid increase in the opening degree of the secondary throttle valve 8b. Thus fuel is supplied to the secondary side to increase the power. At the same time, the switch 29 is turned on, so that the feedback control is stopped and the air-fuel ratio is fixed to a rich value as described above. As shown in FIG. 3, the fixed duty ratio range is narrow under a middle speed zone and is remarkably wide in a high speed zone. Thus in the high speed zone, the output of the engine is increased most effectively.

Although the engine operating condition is detected by the switch 29 provided in the actuator 11, another detecting device such as a transducer comprising a coil provided around the link 15 and an electric detecting device can be employed. Further, although the fixed duty ratio signal is fed to the comparator 34, it may be fed to the input of the proportional and integrating circuit 33 and the switch 35 is provided to cut off the output of the comparator 31.

Figure 5:
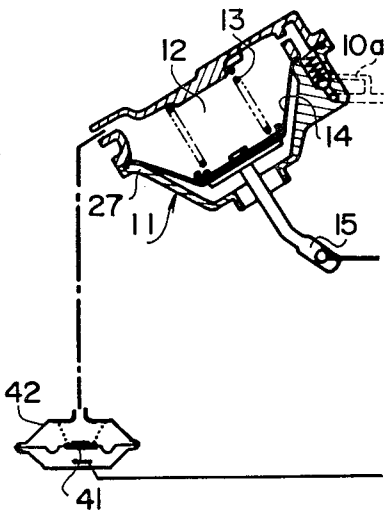
FIG. 5 shows a part of another embodiment of the present invention.

FIG. 5 shows a part of another embodiment of the present invention. In this embodiment, a vacuum operated switch 41 is provided. A vacuum chamber 42 of the switch communicates with the vacuum chamber of the actuator 11, so that the switch is closed depending on the balance between the venturi vacuum and the spring strength of the vacuum chamber 42.

The construction of other portions and operation are the same as that of the previous embodiment.

As described above, according to the present invention, in comparison with the conventional intake passage vacuum method and throttle opening degree method, the fixed air-fuel ratio range is almost zero in a low speed zone, and is very wide in a high speed zone. Therefore, the exhaust gas purification is most effectively achieved when the vehicle provided with this system is driven at a low speed and heavy load which is usual in driving on city streets. Also the driveability and acceleration are improved during high speed driving.

While the presently preferred embodiments of the present invention have been shown and described, it is to be understood that this disclosure is for the purpose of illustration and that various changes and modifications may be made without departing from the spirit and scope of the invention as set forth in the appended claims.

What is claimed is:

1. In an air-fuel ratio control system for an internal combustion engine having a two-barrel carburetor with primary and secondary intake passages, primary and secondary venturis in said intake passages, a throttle valve in the primary intake passage, an exhaust passage, an $O_2$ sensor for detecting the concentration of a constituent of exhaust gases passing through said exhaust passage, an on-off electromagnetic valve for correcting the air-fuel ratio of the air-fuel mixture supplied by said wo-barrel carburetor, the improvement which comprises an electronic control circuit comprising a closed loop feedback control circuit comprising a comparator for comparing an output signal of said $O_2$ sensor with a reference value, a proportional and integrating circuit operatively connected to said comparator, and a driving circuit means for producing driving pulses for driving said electromagnetic valve in dependency on a signal fed thereto, said driving circuit means operatively receiving and driving said electromagnetic valve in dependency on an output signal of said proportional and integrating circuit for controlling the air-fuel ratio to a value approximate to the stoichiometric air-fuel ratio, and a fixed signal generating circuit means for supplying a rich air-fuel ratio signal to said driving circuit means, detecting means comprising a vacuum operated device having a diaphragm responsive to the vacuum at said venturis, for detecting a condition of operation of said internal combustion engine and producing a detected signal upon a predetermined high venturi vacuum, a throttle valve in said secondary intake passage being operatively connected with said vacuum operated device for actuating the throttle valve in dependency on said high venturi vacuum, and switch means for being operated by said detected signal of said detecting means for rendering said closed loop feedback control circuit inoperative and for operatively feeding said fixed signal to said driving circuit means, whereby a rich ratio of the air-fuel mixture is supplied.

2. An air-fuel ratio control system according to claim 1 wherein said vacuum operated device having a diaphragm defining a vacuum chamber communicating with said venturis so as to be actuated by the vacuum at said venturis of the carburetor for opening said throttle valve in the secondary intake passage side.

3. An air-fuel ratio control system according to claim 2 wherein said detecting means includes a switch operated by said diaphragm.

4. The air-fuel ratio control system according to claim 1, wherein a link connects said throttle valve in said secondary intake passage with said vacuum operated device, said detecting means further comprises a transducer comprising a coil around said link.

5. The air-fuel ratio control system according to claim 1, wherein said detecting means includes an electric detecting device.

6. The air-fuel ratio control system according to claim 1, wherein said switch means is operated exclusively by said detected signal of said detecting means.

7. The air-fuel ratio control system according to claim 1, wherein said predetermined high venturi vacuum defines a curve of engine torque as a function of engine speed such that for the engine torque above said curve a fixed rich air-fuel ratio range of torque is defined widening with an increase in engine speed starting substantially zero in a low speed zone, narrow in a middle speed zone and very wide in a high speed zone.

* * * * *